United States Patent [19]

Garconnet

[11] 4,069,726

[45] Jan. 24, 1978

[54] TIGHTENING AND RELEASING TOOL

[76] Inventor: Michel Jean Garconnet, 22, rue du Docteur Viter, Saint Nicolas d'Aliermont, France

[21] Appl. No.: 676,611

[22] Filed: Apr. 13, 1976

[30] Foreign Application Priority Data

Apr. 14, 1975 France ..... 75 11579

[51] Int. Cl.[2] ..... B25B 17/02

[52] U.S. Cl. ..... 74/785; 74/801; 81/57.31

[58] Field of Search ..... 74/785, 788, 797, 801; 81/57.31

[56] References Cited

U.S. PATENT DOCUMENTS

| | | | |
|---|---|---|---|
| 2,606,472 | 8/1952 | Curtis et al. | 74/801 |
| 2,715,834 | 8/1955 | Chamberlin | 74/801 |
| 3,330,171 | 7/1967 | Nasvgtis | 74/801 |

*Primary Examiner*—Stephen C. Bentley
*Attorney, Agent, or Firm*—Parmelee, Johnson & Bollinger

[57] ABSTRACT

The invention relates to a tightening and releasing tool of small dimensions, allowing considerable reduction in the force to be applied thereto to perform tightening and releasing operations.

2 Claims, 4 Drawing Figures

TIGHTENING AND RELEASING TOOL

The present invention relates to a tightening and releasing tool of small dimensions, allowing considerable reduction in the force to be applied thereto to perform tightening and releasing operations.

The invention is characterised in that the tightening and releasing tool comprises an input and an output shaft arranged to be connected to a member to be tightened or released, the shafts being rotatably mounted on a support; means on the support for blocking the support in position when a tightening and releasing operation is performed; a pinion rigid with one shaft; and at least one cheek plate rigid with the other shaft, at least one pair of pinions of different diameter, rigid with one another, and freely rotatable on the cheek plate; one of the pair of pinions meshing with the pinion rigid with one of the shafts and the other with a pinion rigid with the support.

In an embodiment of the invention, the support is a plate-shaped case housing the pinions and the cheek plate, the two shafts projecting outwards at the centre of each of the faces of the case.

According to another embodiment, the pinion rigid with the support comprises an internal gear and the output shaft is rigid with the cheek plate.

The invention is illustrated by way of nonlimiting example in the accompanying drawings, in which.

Figure 1:
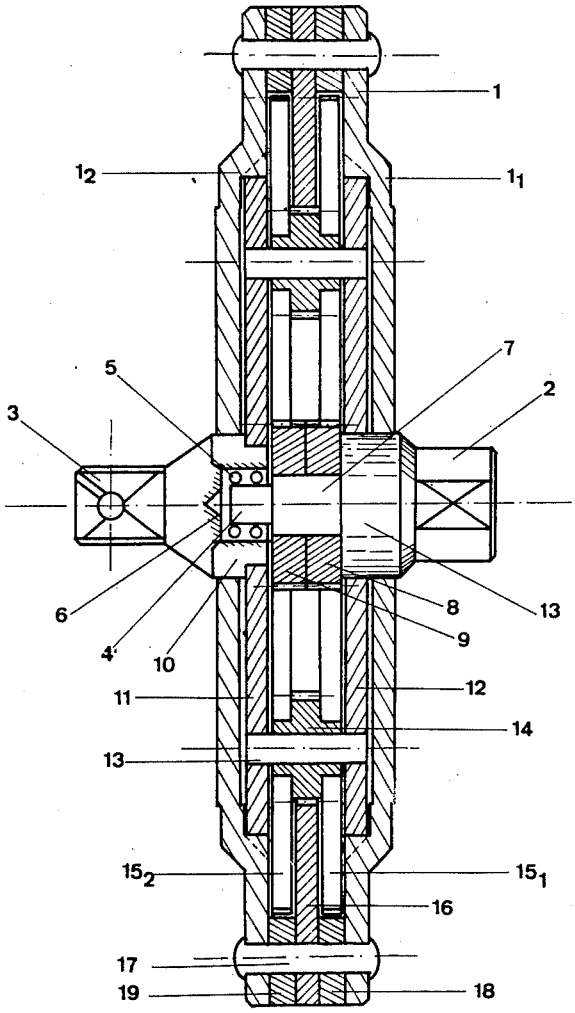
FIG. 1 is an axial cross-sectional view of a tool according to a first embodiment of the invention.
Figure 2:
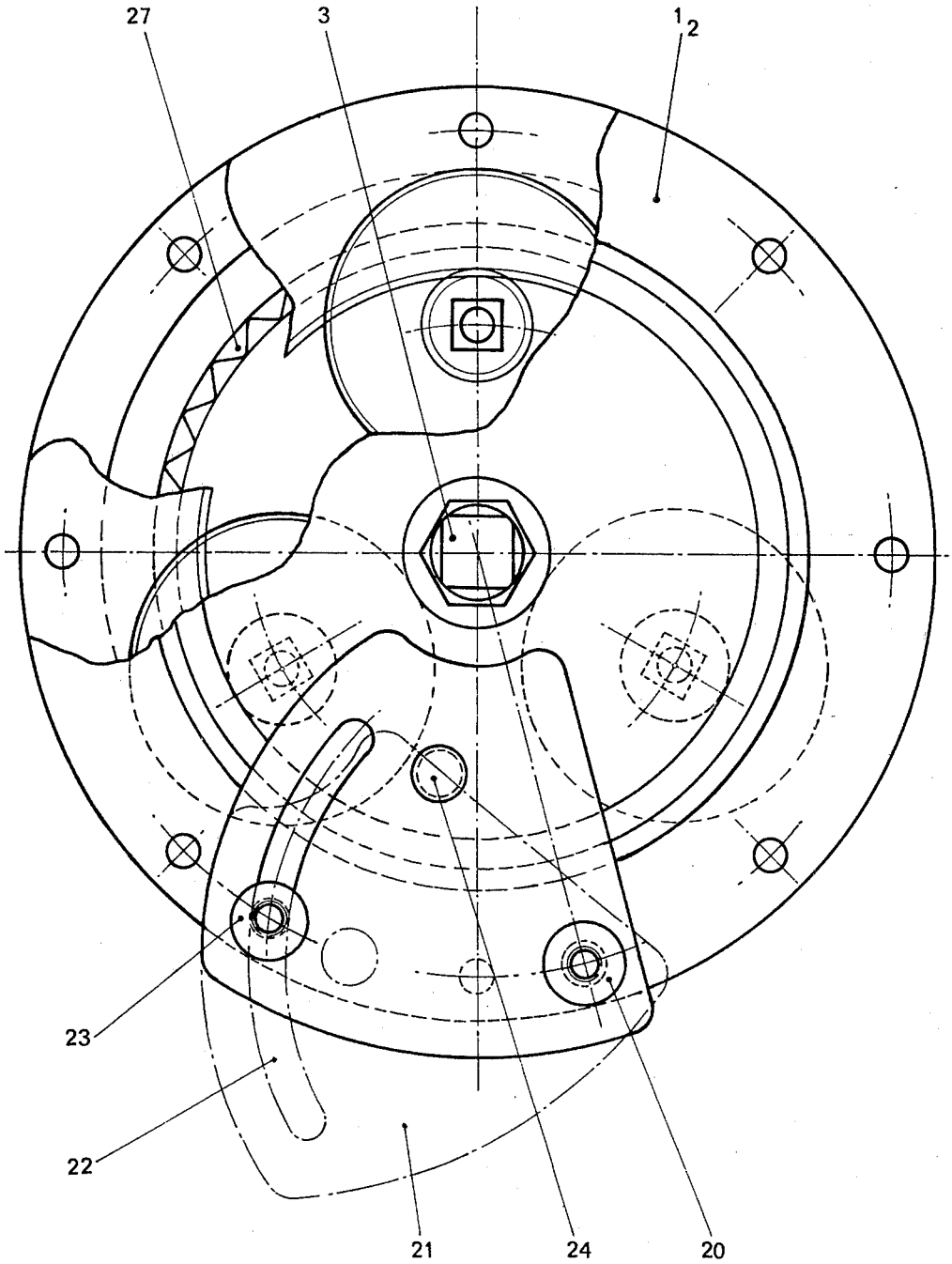
FIG. 2 is a view from the left of FIG. 1 and illustrates the inner arrangement of the various pinions.
Figure 3:
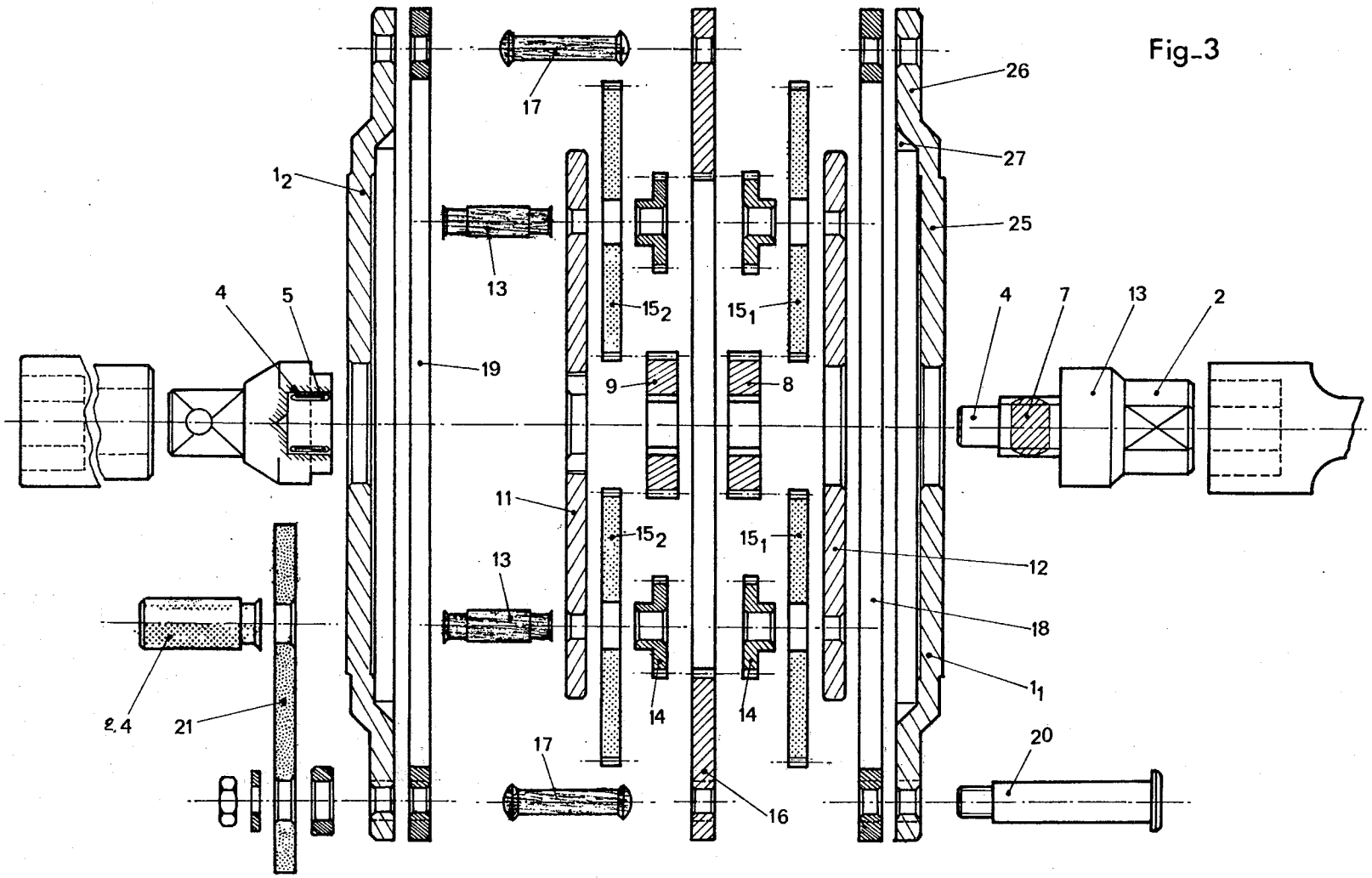
FIG. 3 is an exploded view of the tool of FIG. 1.

The device according to the invention shown in FIGS. 1 to 3 comprises a case 1 housing a group of pinions forming a tightening tool.

The case 1 is plate-shaped and is constituted by two halves $1_1$ and $1_2$ at the centre of which the ends of an input shaft 2 and an output shaft 3 project outwards.

The two shafts 2 and 3 are rotatably mounted one within the other at their adjacent ends. To this end, the shaft 2 has a cylindrical extension 4 which is mounted by means of a ball bearing 5 in a space 6 formed at the end of the shaft 3.

Owing to such a construction, the two shafts 2 and 3 which are rotatably mounted and centered on the two halves $1_1$ and $1_2$, are also centered and mounted for rotation one with respect to the other. In this way, a strong mounting for the assembly is obtained notwithstanding its small dimensions.

A pinion comprising two parts 8 and 9 is fixed to a zone 7 of the shaft 2, whereas a cheek plate 11 is fixed to a bearing surface 10 of the shaft 3.

A further cheek plate 12 is mounted parallel to the cheek plate 11 and freely rotatable on a portion 13 of the shaft 2, the two cheek plates 11 and 12 locating therebetween pairs of rotatable pinions rigid with one another and having a first pinion 14 and a second pinion comprising two parts $15_1$ and $15_2$ surrounding the pinion 14. The two pinion parts $15_1$ and $15_2$ mesh with two pinion parts 8 and 9 while the inner pinion 14 meshes with an internal gear 16 fixed to the periphery of the two halves $1_1$ and $1_2$ by means of rivets 17.

Spacer discs 18 and 19 arranged to compensate for the thickness of the two pinion parts $15_1$ and $15_2$ are provided around the rivets 17 and on each side of the internal gear 16.

A plate 21 formed with a slot 22 in the shape of an arc of a circle is pivotably mounted on the half-case $1_2$ by means of a screw 20. A securing screw 23 extends through the slot 22 and is fixed to the case. The plate 21 carries a peg 24 arranged to act as a stop to prevent rotation of the case when a tightening or release force is applied to the shaft 2.

In an embodiment of the tool, the ouput shaft 3 is advantageously fixed to a member to be tightened or released by means of any adjustable socket, and the peg 24 is placed in abutting position against an element locating the member to be released in order to prevent it from rotating. By means of a wrench, the input shaft 2 is then rotated so as to produce a first reduction in rotation between the pinions 8, 9 and the pinions $15_1$, $15_2$; the pinions $15_1$ and $15_2$ then rotate the pinions 14 which by meshing with the internal gear 16, in turn, rotate the cheek plates 11 and 12 at reduced speed. The cheek plate 11 thus drives the output shaft 3 at a revolving speed which is reduced with respect to the revolving speed of the input shaft 2, the speed reduction depending on the ratio between the number of teeth of the internal gear 16 and that of the pinion 14, and on the ratio between the number of teeth of the pinions 8, 9 and that of the pinions $15_1$ and $15_2$.

It will also be noted that the tool according to the invention may be of simple construction since all the components, apart from the input and output shafts 2, 3, as well as the bearing axes 17, are obtained by stamping-cutting operations.

In particular, the two half-cases $1_1$ and $1_2$ are obtained by stamping-cutting sheet plates, and, in order to give each half-case good stiffness, a central zone 25 thereof is lowered or recessed, by stamping, with respect to a peripheral zone 26. According to the invention, the stamping operation is performed in such a manner as to form a succession of radial teeth 27 arranged to provide stiffening for the half-cases. Moreover, the tips of the stamped teeth 27 define guides with a minimum of friction for the periphery of the cheek plates 11 and 12.

Figure 4:
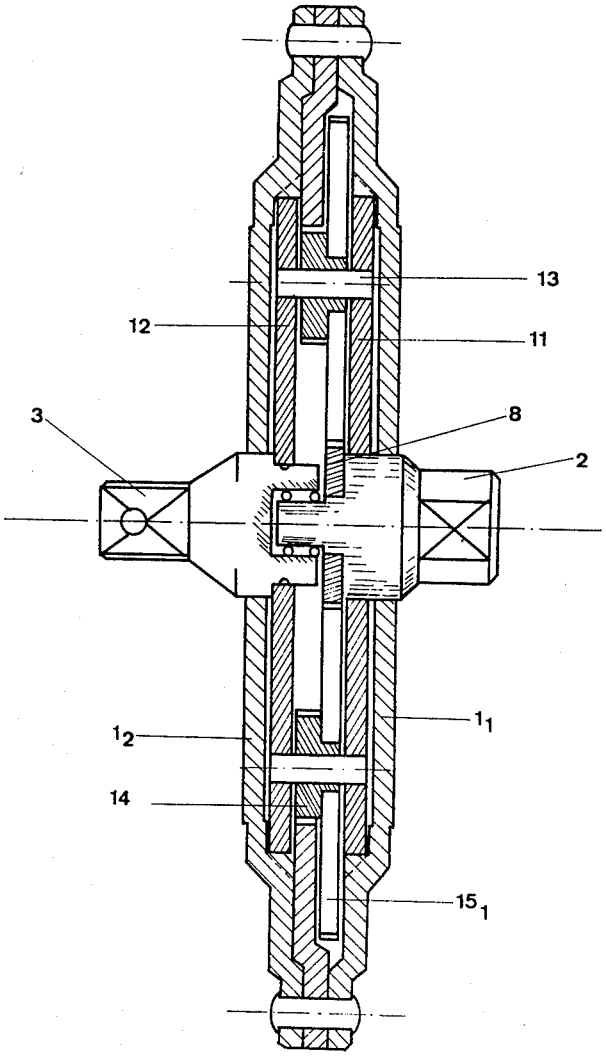
FIG. 4 is a cross-sectional view of a simplified embodiment of the tool.

FIG. 4 shows an embodiment of a simplified tightening and releasing tool, which does not comprise the pinions 9 and $15_2$ and the annular spacers 18 and 19.

In this case, the pinion 2 is rigid with one pinion 8 meshing with a pinion $15_1$ which is rigid with a pinion 14. Although this arrangement is simpler in construction, in certain cases it may be considered less stout owing to lack of balance when its mechanical components are moving.

It should be understood that the invention is not limited to the embodiments described and illustrated above, and that other embodiments and variants may be made within the scope of the invention.

I claim:

1. A tightening and releasing tool comprising an input shaft to which a tightening or releasing force is applied: an output shaft arranged to be applied to a member to be tightened or released; said shafts being rotatably mounted on a support having an internal gear; blocking means on said support for preventing rotation of the support when performing a tightening or releasing operation; a first pinion rigid with one shaft; and a pair of cheek plates rigid with the other shaft; said tool being characterized in that a pair of pinions of different diameter from, and rigid with, one another are arranged freely rotatable between the two cheek plates, one of these pinions meshing with said first pinion while the other of these pinions meshes with said internal gear; and said pair of pinions is subdivided and forms a symmetrical construction with the internal gear so that the internal gear and the pinions in said pair of pinions are imbricated one inside the other.

2. A tightening and releasing tool as claimed in claim 1, in which the pinion of greater diameter in the pair of pinions is subdivided and surrounds the pinion of smaller diameter which meshes with the internal gear.

* * * * *